US006525630B1

(12) United States Patent
Zhu et al.

(10) Patent No.: US 6,525,630 B1
(45) Date of Patent: Feb. 25, 2003

(54) MICROSTRIP TUNABLE FILTERS TUNED BY DIELECTRIC VARACTORS

(75) Inventors: Yongfei Zhu, Columbia, MD (US); Louise C. Sengupta, Warwick, MD (US); Yu Rong, Gaithersburg, MD (US)

(73) Assignee: Paratek Microwave, Inc., Columbia, MD (US)

( * ) Notice: Subject to any disclaimer, the term of this patent is extended or adjusted under 35 U.S.C. 154(b) by 0 days.

(21) Appl. No.: 09/704,850

(22) Filed: Nov. 2, 2000

Related U.S. Application Data

(60) Provisional application No. 60/163,498, filed on Nov. 4, 1999.

(51) Int. Cl.[7] ..... H01P 1/20

(52) U.S. Cl. ..... 333/205; 333/204

(58) Field of Search ..... 333/205, 204, 333/246; 427/126.3

(56) References Cited

U.S. PATENT DOCUMENTS

| | | | | |
|---|---|---|---|---|
| 4,266,208 A | * | 5/1981 | Cornish | 333/218 |
| 4,551,696 A | | 11/1985 | Moutrie et al. | |
| 4,578,656 A | | 3/1986 | Lacour et al. | |
| 4,757,287 A | | 7/1988 | Grandfield et al. | |
| 4,835,499 A | | 5/1989 | Pickett | |
| 4,963,843 A | | 10/1990 | Peckham | |
| 5,021,757 A | * | 6/1991 | Kobayashi et al. | 333/205 |

(List continued on next page.)

FOREIGN PATENT DOCUMENTS

| | | |
|---|---|---|
| JP | 60220602 | 11/1985 |
| JP | 60223304 | 11/1985 |
| WO | WO94/13028 | 6/1994 |
| WO | WO98/20606 | 5/1998 |

OTHER PUBLICATIONS

U.S. patent application Ser. No. 09/419,126, Sengupta et al., filed Oct. 15, 1999.

Gevorgian et al., "Electrically controlled HTSC/ferroelectric coplanar waveguide", *IEEE Proceedings–H: Microwave Antennas and Propagation*, Dec. 1994, pp. 501–503, vol. 141, No. 6.

Swanson Jr, "Microstrip Filter Design Using Electromagnetics", Rev. B Aug. 26, 1995.

Kozyrev et al., "Ferroelectric Films: Nonlinear Properties and Applications in Microwave Devices", *IEEE*, 1998, pp. 985–988.

*Primary Examiner*—Robert Pascal
*Assistant Examiner*—Joseph Chang
(74) *Attorney, Agent, or Firm*—Robert P. Lenart; Michael N. Haynes; William J. Tucker

(57) ABSTRACT

An electronic filter includes a substrate, a ground conductor, an input, an output, a first microstrip line positioned on the substrate and electrically coupled to the input and the output, and a first tunable dielectric varactor electrically connected between the microstrip line and the ground conductor. The input preferably includes a second microstrip line positioned on the substrate and including a portion lying parallel to the first microstrip line. The output preferable includes a third microstrip line positioned on the substrate and including a portion lying parallel to the first microstrip line. The first microstrip line includes a first end and a second end, the first end being open circuited and the varactor being connected between the second end and the ground conductor. The filter further includes a bias voltage circuit including a high impedance line, a radial stub extending from the high impedance line, and a patch connected to the high impedance line for connection to a DC source. In a multiple pole embodiment, the filter further includes additional microstrip lines positioned on the filter substrate parallel to the first microstrip line and additional tunable dielectric varactors electrically connected between the additional microstrip lines and the ground conductor.

16 Claims, 4 Drawing Sheets

U.S. PATENT DOCUMENTS 5,138,288 A 8/1992 Blackburn
5,248,949 A 9/1993 Eguchi et al.
5,248,950 A 9/1993 Horisawa et al.
5,321,374 A 6/1994 Uwano
5,392,011 A 2/1995 Li
5,406,233 A 4/1995 Shih et al.
5,461,352 A 10/1995 Noguchi et al.
5,472,935 A 12/1995 Yandrofski et al.
5,483,206 A 1/1996 Lohninger
5,496,795 A 3/1996 Das
5,496,796 A 3/1996 Das
5,543,764 A 8/1996 Turunen et al.
5,640,042 A 6/1997 Koscica et al.
5,721,194 A 2/1998 Yandrofski et al.
5,877,123 A 3/1999 Das
5,908,811 A 6/1999 Das
5,917,387 A 6/1999 Rice et al.
6,054,908 A 4/2000 Jackson
6,071,555 A * 6/2000 Sengupta et al. ..... 427/126.3
6,111,482 A 8/2000 Atokawa

* cited by examiner

MICROSTRIP TUNABLE FILTERS TUNED BY DIELECTRIC VARACTORS

CROSS REFERENCE TO RELATED APPLICATION

This application claims the benefit of the filing date of U.S. Provisional Application No. 60/163,498, filed Nov. 4, 1999.

FIELD OF INVENTION

The present invention relates generally to electronic filters, and more particularly, to tunable filters that operate at microwave frequencies at room temperature.

BACKGROUND OF INVENTION

Electrically tunable microwave filters have many applications in microwave systems. These applications include local multipoint distribution service (LMDS), personal communication systems (PCS), frequency hopping radio, satellite communications, and radar systems. There are three main kinds of microwave tunable filters, mechanically, magnetically, and electrically tunable filters. Mechanically tunable filters are usually tuned manually or by using a motor. They suffer from slow tuning speed and large size. A typical magnetically tunable filter is the YIG (Yttrium-Iron-Garnet) filter, which is perhaps the most popular tunable microwave filter, because of its multioctave tuning range, and high selectivity. However, YIG filters have low tuning speed, complex structure, and complex control circuits, and are expensive.

One electronically tunable filter is the diode varactor-tuned filter, which has a high tuning speed, a simple structure, a simple control circuit, and low cost. Since the diode varactor is basically a semiconductor diode, diode varactor-tuned filters can be used in monolithic microwave integrated circuits (MMIC) or microwave integrated circuits. The performance of varactors is defined by the capacitance ratio, $C_{max}/C_{min}$, frequency range, and figure of merit, or Q factor at the specified frequency range. The Q factors for semiconductor varactors for frequencies up to 2 GHz are usually very good. However, at frequencies above 2 GHz, the Q factors of these varactors degrade rapidly.

Since the Q factor of semiconductor diode varactors is low at high frequencies (for example, <20 at 20 GHz ), the insertion loss of diode varactor-tuned filters is very high, especially at high frequencies (>5 GHz ). Another problem associated with diode varactor-tuned filters is their low power handling capability. Since diode varactors are nonlinear devices, larger signals generate harmonics and subharmonics.

Varactors that utilize a thin film ferroelectric ceramic as a voltage tunable element in combination with a superconducting element have been described. For example, U.S. Pat. No. 5,640,042 discloses a thin film ferroelectric varactor having a carrier substrate layer, a high temperature superconducting layer deposited on the substrate, a thin film dielectric deposited on the metallic layer, and a plurality of metallic conductive means disposed on the thin film dielectric, which are placed in electrical contact with RF transmission lines in tuning devices. Another tunable capacitor using a ferroelectric element in combination with a superconducting element is disclosed in U.S. Pat. No. 5,721,194.

Commonly owned U.S. patent application Ser. No. 09/419,126, filed Oct. 15, 1999, and titled "Voltage Tunable Varactors And Tunable Devices Including Such Varactors", discloses voltage tunable dielectric varactors that operate at room temperature and various devices that include such varactors, and is hereby incorporated by reference.

There is a need for tunable filters that can operate at radio frequencies with reduced intermodulation products and at temperatures above those necessary for superconduction.

SUMMARY OF THE INVENTION

This invention provides an electronic filter including a substrate, a ground conductor, an input, an output, a first microstrip line positioned on the substrate and electrically coupled to the input and the output, and a first tunable dielectric varactor electrically connected between the microstrip line and the ground conductor. The input preferably includes a second microstrip line positioned on the substrate and having a portion lying parallel to the first microstrip line. The output preferable includes a third microstrip line positioned on the substrate and having a portion lying parallel to the first microstrip line. The first microstrip line includes a first end and a second end, the first end being open circuited and the varactor being connected between the second end and the ground conductor. The filter further includes a bias voltage circuit for supplying control voltage to the varactor. In the preferred embodiment, the bias circuit includes a high impedance line, a radial stub extending from the high impedance line, and a patch connected to the high impedance line for connection to a DC source. The varactor preferably includes a substrate having a low dielectric constant with a planar surface, a tunable dielectric layer on the planar substrate, with the tunable dielectric layer including a Barium Strontium Titanate composite, and first and second electrodes on the tunable dielectric layer and positioned to form a gap between the first and second electrodes. In a multiple pole embodiment, the filter further includes additional microstrip lines positioned on the filter substrate parallel to the first microstrip line and additional tunable dielectric varactors electrically connected between the additional microstrip lines and the ground conductor.

DETAILED DESCRIPTION OF THE INVENTION

Figure 1:
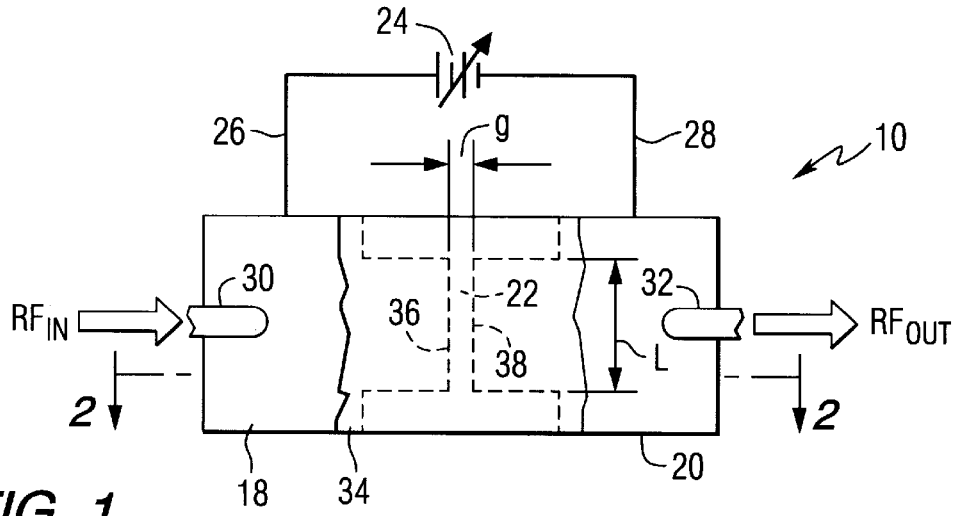
FIG. 1 PRIOR ART
FIG. 1 is a top plan view of a voltage tunable dielectric varactor that can be used in the filters of the present invention.
Figure 2:
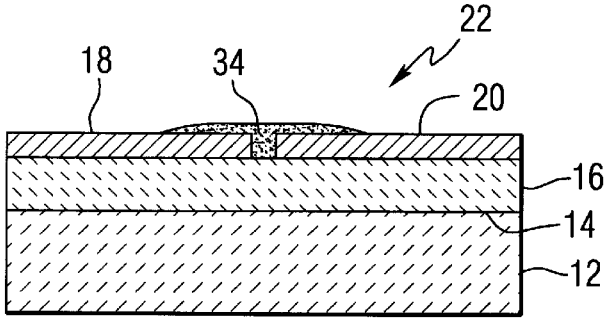
FIG. 2 PRIOR ART
FIG. 2 is a cross sectional view of the varactor of FIG. 1, taken along line 2—2.

Referring to the drawings, FIGS. 1 and 2 are top and cross sectional views of a tunable dielectric varactor 10 that can be used in filters constructed in accordance with this invention. The varactor 10 includes a substrate 12 having a generally planar top surface 14. A tunable ferroelectric layer 16 is positioned adjacent to the top surface of the substrate. A pair of metal electrodes 18 and 20 are positioned on top of the ferroelectric layer. The substrate 12 is comprised of a material having a relatively low permittivity such as MgO, Alumina, $LaAlO_3$, Sapphire, or a ceramic. For the purposes of this description, a low permittivity is a permittivity of less than about 30. The tunable ferroelectric layer 16 is comprised of a material having a permittivity in a range from about 20 to about 2000, and having a tunability in the range from about 10% to about 80% when biased by an electric field of about 10 V/$\mu$m. The tunable dielectric layer is preferably comprised of Barium-Strontium Titanate, $Ba_xSr_{1-x}TiO_3$ (BSTO), where x can range from zero to one, or BSTO-composite ceramics. Examples of such BSTO composites include, but are not limited to: BSTO—MgO, BSTO—$MgAl_2O_4$, BSTO—$CaTiO_3$, BSTO—$MgTiO_3$, BSTO—$MgSrZrTiO_6$, and combinations thereof. The tunable layer in one preferred embodiment of the varactor has a dielectric permittivity greater than 100 when subjected to typical DC bias voltages, for example, voltages ranging from about 5 volts to about 300 volts. A gap 22 of width g, is formed between the electrodes 18 and 20. The gap width can be optimized to increase the ratio of the maximum capacitance $C_{max}$ to the minimum capacitance $C_{min}$ ($C_{max}/C_{min}$) and increase the quality factor (Q) of the device. The optimal width, g, is the width at which the device has maximum $C_{max}/C_{min}$ and minimal loss tangent. The width of the gap can range from 5 to 50 $\mu$m depending on the performance requirements.

A controllable voltage source 24 is connected by lines 26 and 28 to electrodes 18 and 20. This voltage source is used to supply a DC bias voltage to the ferroelectric layer, thereby controlling the permittivity of the layer. The varactor also includes an RF input 30 and an RF output 32. The RF input and output are connected to electrodes 18 and 20, respectively, such as by soldered or bonded connections.

In typical embodiments, the varactors may use gap widths of less than 50 $\mu$m, and the thickness of the ferroelectric layer ranges from about 0.1 $\mu$m to about 20 $\mu$m. A sealant 34 can be positioned within the gap and can be any non-conducting material with a high dielectric breakdown strength to allow the application of high voltage without arcing across the gap. Examples of the sealant include epoxy and polyurethane.

The length of the gap L can be adjusted by changing the length of the ends 36 and 38 of the electrodes. Variations in the length have a strong effect on the capacitance of the varactor. The gap length can be optimized for this parameter. Once the gap width has been selected, the capacitance becomes a linear function of the length L. For a desired capacitance, the length L can be determined experimentally, or through computer simulation.

The thickness of the tunable ferroelectric layer also has a strong effect on the $C_{max}/C_{min}$. The optimum thickness of the ferroelectric layer is the thickness at which the maximum $C_{max}/C_{min}$ occurs. The ferroelectric layer of the varactor of FIGS. 1 and 2 can be comprised of a thin film, thick film, or bulk ferroelectric material such as Barium-Strontium Titanate, $Ba_xSr_{1-x}TiO_3$ (BSTO), BSTO and various oxides, or a BSTO composite with various dopant materials added. All of these materials exhibit a low loss tangent. For the purposes of this description, for operation at frequencies ranging from about 1.0 GHz to about 10 GHz, the loss tangent would range from about 0.001 to about 0.005. For operation at frequencies ranging from about 10 GHz to about 20 GHz, the loss tangent would range from about 0.005 to about 0.01. For operation at frequencies ranging from about 20 GHz to about 30 GHz, the loss tangent would range from about 0.01 to about 0.02.

The electrodes may be fabricated in any geometry or shape containing a gap of predetermined width. The required current for manipulation of the capacitance of the varactors disclosed in this invention is typically less than 1 $\mu$A. In the preferred embodiment, the electrode material is gold. However, other conductors such as copper, silver or aluminum, may also be used. Gold is resistant to corrosion and can be readily bonded to the RF input and output. Copper provides high conductivity, and would typically be coated with gold for bonding or nickel for soldering.

Figure 3:
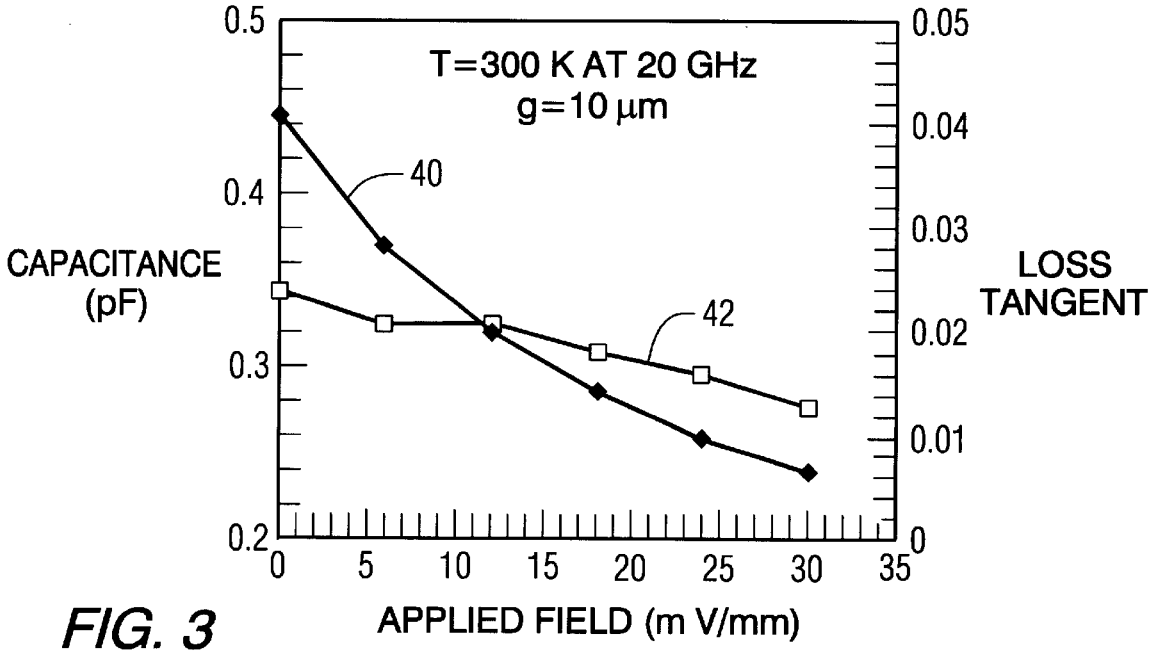
FIG. 3 is a graph that illustrates the properties of the dielectric varactor of FIG. 1.

Voltage tunable dielectric varactors as shown in FIGS. 1 and 2 can have Q factors ranging from about 50 to about 1000 when operated at frequencies ranging from about 1 GHz to about 40 GHz. The typical Q factor of the dielectric varactor is about 1000 to 200 at 1 GHz to 10 GHz, 200 to 100 at 10 GHz to 20 GHz, and 100 to 50 at 20 to 30 GHz. $C_{max}/C_{min}$ is about 2, which is generally independent of frequency. The capacitance (in pF) and the loss factor (tan $\delta$) of a varactor measured at 20 GHz for gap distance of 10 $\mu$m at 300° K. is shown in FIG. 3. Line 40 represents the capacitance and line 42 represents the loss tangent.

Figure 4:
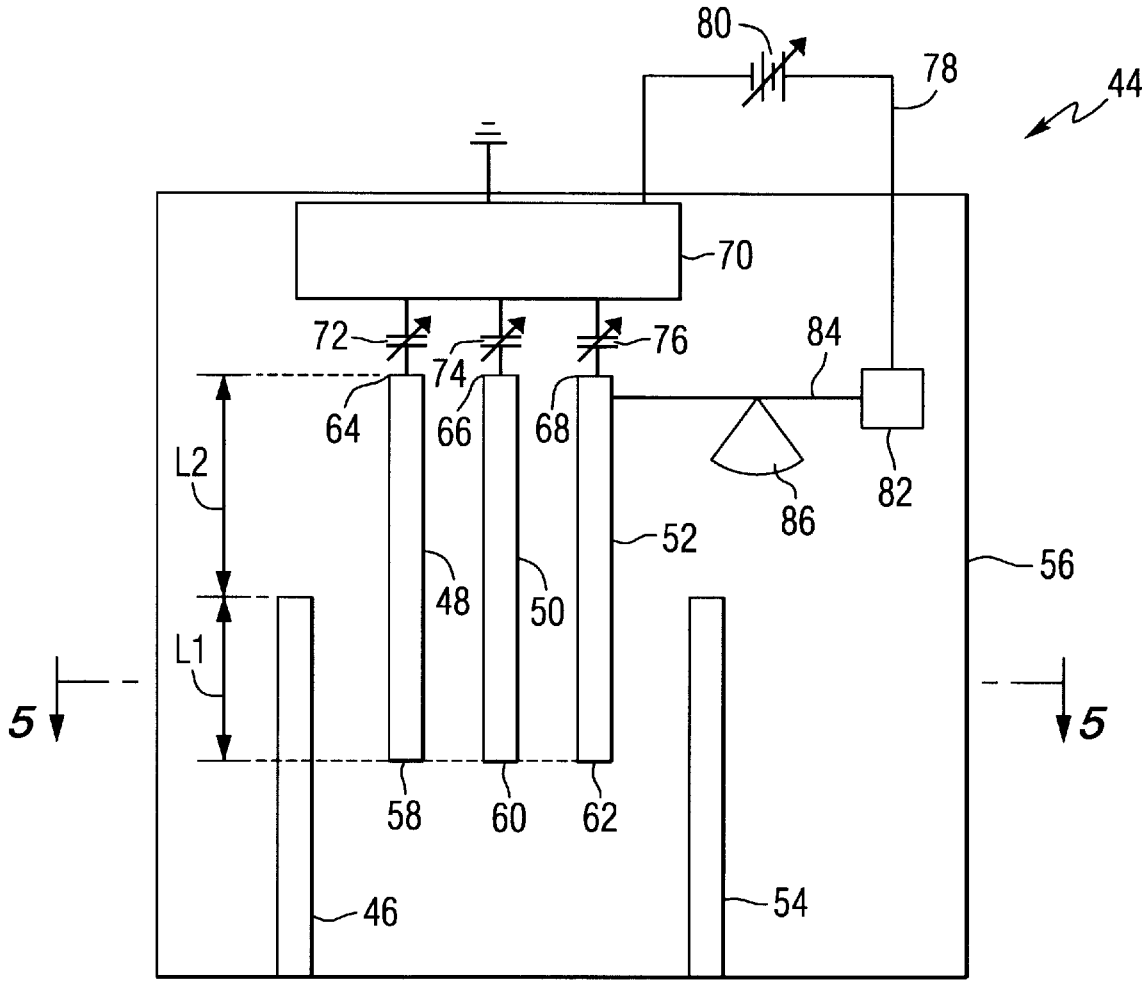
FIG. 4 is a plan view of a tunable filter constructed in accordance with the preferred embodiment of this invention.
Figure 5:
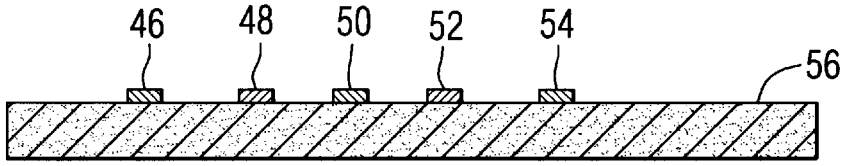
FIG. 5 is a cross sectional view of the filter of FIG. 4, taken along line 5—5.

FIG. 4 is a plan view of a K-band microstrip comb-line tunable 3-pole filter 44, tuned by dielectric varactors shown in FIGS. 1 and 2, constructed in accordance with the preferred embodiment of this invention. FIG. 5 is a cross sectional view of the filter of FIG. 4, taken along line 5—5. Filter 44 includes a plurality of resonators in the form of microstrip lines 48, 50, and 52 positioned on a planar surface of a substrate 56. The microstrip lines extend in directions parallel to each other. Lines 46 and 54 serve as an input and an output respectively. Line 46 includes a first portion that extends parallel to line 48 for a distance L1. Line 54 includes a first portion that extends parallel to line 52 for a distance L1. Lines 46, 48 and 50 are equal in length and are positioned side by side with respect to each other. First ends 58, 60 and 62 of lines 46, 48 and 50 are unconnected, that is, open circuited. Second ends 64, 66 and 68 of lines 46, 48 and 50 are connected to a ground conductor 70 through tunable dielectric varactors 72, 74 and 76. In the preferred embodiment, the varactors are constructed in accordance with FIGS. 1 and 2, and operate at room temperature. While a three-pole filter is described herein to illustrate the invention, microstrip combine filters of the present invention typically have 2 to 6 poles. Additional poles can be added by adding more strip line resonators in parallel to those shown in FIG. 4.

A bias voltage circuit is connected to each of the varactors. However, for clarity, only one bias circuit 78 is shown in FIG. 4. The bias circuit includes a variable voltage source 80 connected between ground 70 and a connection tab 82. A high impedance line 84 connects tab 82 to line 52. The high impedance line is a very narrow strip line. Because of its narrow width, its impedance is higher than the impedances of the other strip lines in the filter. A stub 86 extends from the high impedance line. The bias voltage circuit serves as a low pass filter to avoid RF signal leakage into the bias line.

The dielectric substrate 56 used in the preferred embodiment of the filter is RT5880 ($\epsilon$=2.22) with a thickness of 0.508 mm (20 mils). Each of the three resonator lines 46, 48 and 50 includes one microstrip line serially connected to a varactor and ground. The other end of each microstrip line is an open-circuit. The open-end design simplifies the DC bias circuits for the varactors. In particular, no DC block is needed for the bias circuit. Each resonator line has a bias circuit. The bias circuit works as a low-pass filter, which includes a high impedance line, a radial stub, and a termination patch to connect to a voltage source. The first and last resonators 48 and 52 are coupled to input and output lines 46 and 54 of the filter, respectively, through the fringing fields coupling between them. Computer-optimized dimensions of microstrips of the tunable filter are L1=1.70 mm, L2=1.61 mm, S1=0.26 mm, S2=5.84 mm, W1=1.52 mm, and W2=2.00 mm. In the preferred embodiment, the substrate is RT5880 with a 0.508 mm thickness and the strip lines are 0.5 mm thick copper. A low loss (<0.002) and low dielectric constant (<3) substrate is desired for this application. Of course, low loss substrates can reduce filter insertion loss, while low dielectric constants can reduce dimension tolerance at this high frequency range. The lengths of the strip lines combined with the varactors determine the filter center frequency. The lengths L1 or L2 strongly affect the filter bandwidth. While the strip line resonators can be different lengths, in practice, the same length is typically used to make the design simple. The parallel orientation of the strip line resonators provides good coupling between them. However, input and output lines 46 and 54 can be bent in the sections that do not provide coupling to the strip line resonators.

The tunable filter in the preferred embodiment of the present invention has a microstrip comb-line structure. The resonators include microstrip lines, open-circuited at one end, with a dielectric varactor between the other end of each microstrip line and ground. Variation of the capacitance of the varactors is controlled by controlling the bias voltage applied to each varactor. This controls the resonant frequency of the resonators and tunes the center frequency of filter. The input and output microstrip lines are not resonators but coupling structures of the filter. Coupling between resonators is achieved through the fringing fields between resonator lines. The simple microstrip comb-line filter structure with high Q dielectric varactors makes the tunable filter have the advantages of low insertion loss, moderate tuning range, low intermodulation distortion, and low cost. The present filter can be integrated into RF systems, and therefore easily combined with other components existing in various radios.

Figure 6:
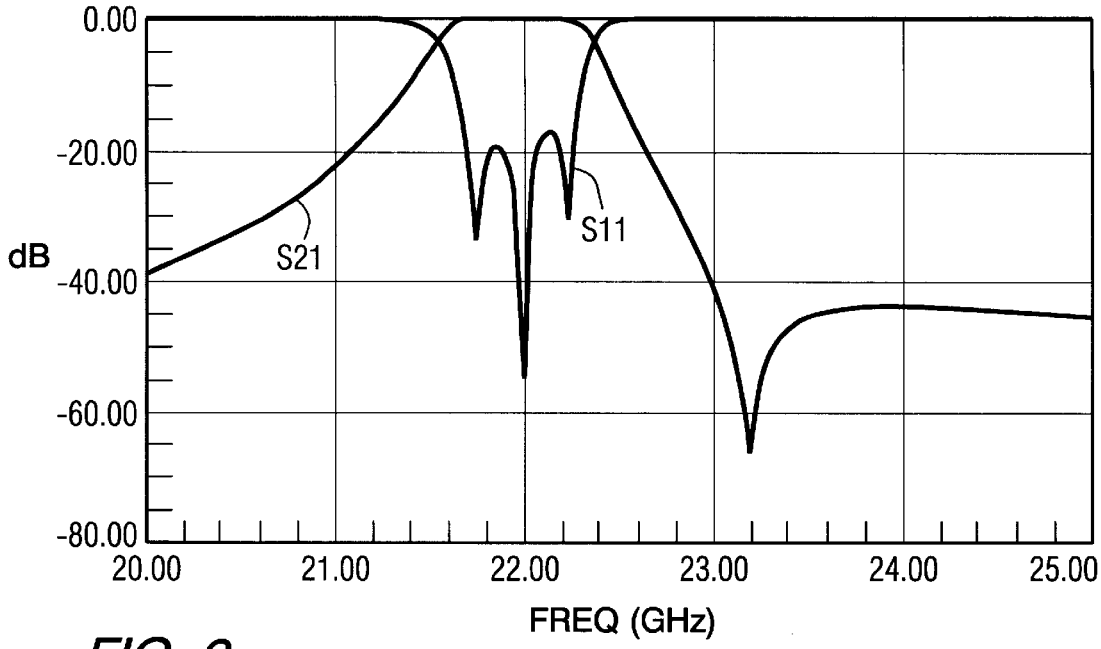
FIG. 6 is a graph of a computer simulated frequency response of the tunable filter of FIG. 4 at zero bias with infinite Q of the varactors.
Figure 7:
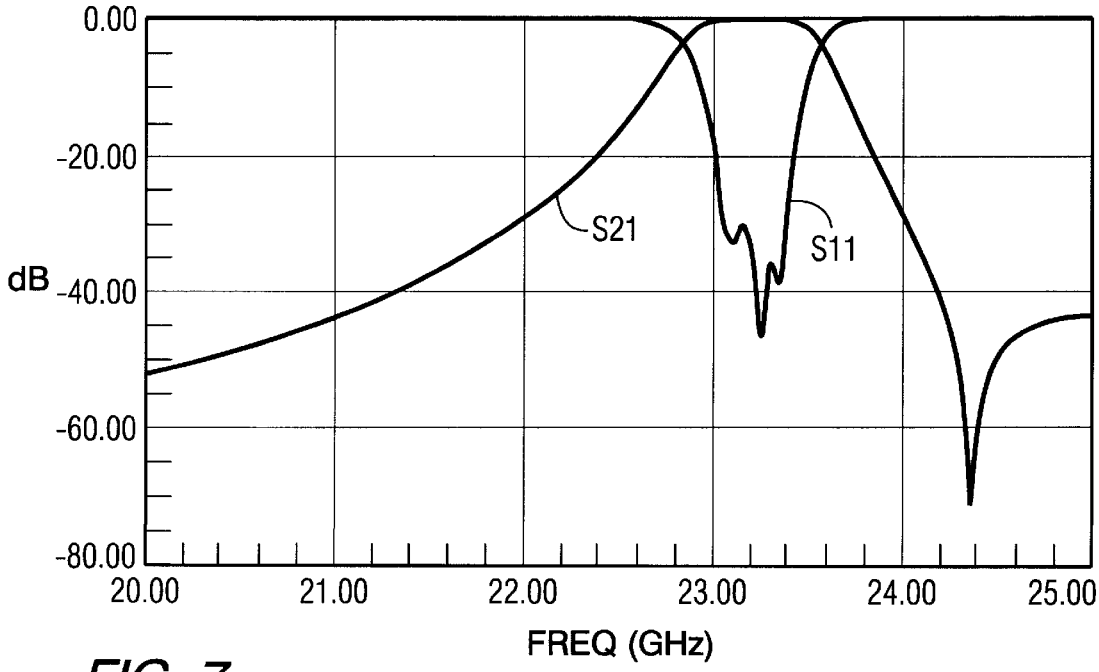
FIG. 7 is a graph of a computer simulated frequency response of the tunable filter of FIG. 4 at zero bias with 200 V bias with infinite Q of the varactors.

FIG. 6 shows a computer-simulated frequency response of the tunable filter with non-biased varactors. The capacitance of each varactor is 0.2 pF at zero bias. The center frequency of the filter is 22 GHz. and the 3 dB bandwidth is 600 MHz. In FIGS. 6 through 9, curve S21 represents the insertion loss, and curve S11 represents the return loss. FIG. 7 is a simulated frequency response of the tunable filter at 200 V bias, where the capacitance of each varactor is 0.14 pF. The frequency of the filter is shifted to 23.2 GHz at 200 V bias. The bandwidth of the filter at 200 V is almost the same as the bandwidth at zero bias.

Figure 8:
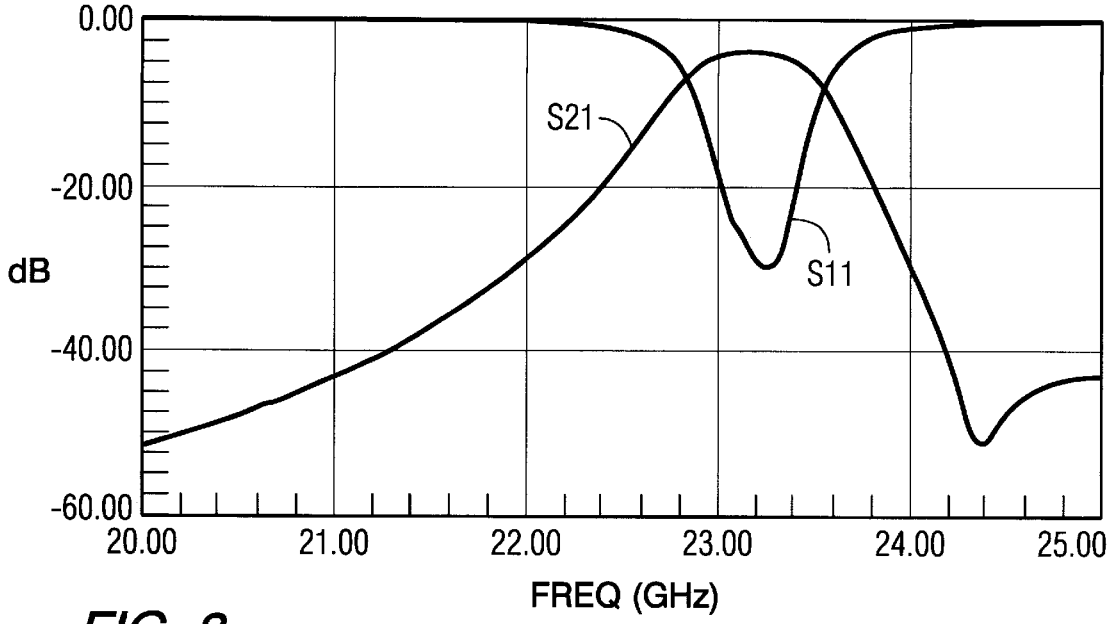
FIG. 8 is a graph of a computer simulated frequency response of the tunable filter of FIG. 4 at zero bias with 200 V bias with varactors having Q=50.
Figure 9:
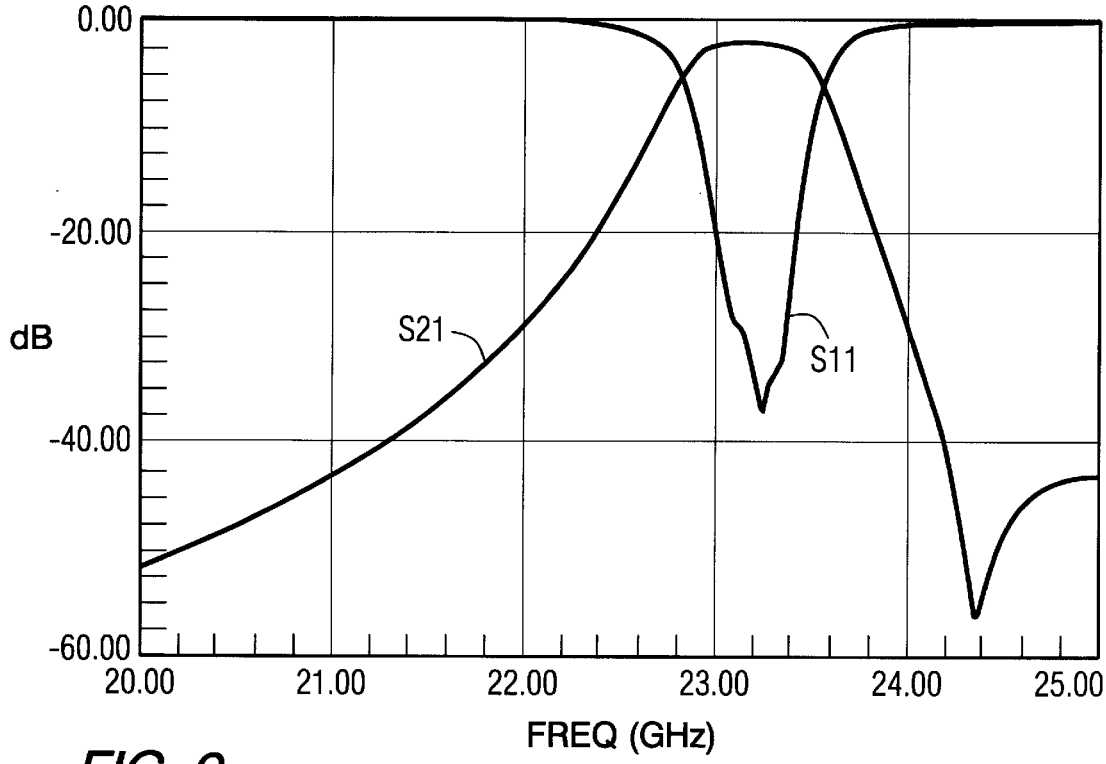
FIG. 9 is a graph of a computer simulated frequency response of the tunable filter of FIG. 4 at zero bias with 200 V bias with varactors having Q=100.

For data in FIGS. 6 and 7, it is assumed that the Q of varactors is infinite. FIG. 8 shows a frequency response of the filter at 200 V bias with varactors having a Q=50. The insertion loss about 3.8 dB. FIG. 9 shows a frequency response of the filter at 200 V bias with varactors having a Q=100. The insertion loss in this case is about 2.1 dB.

The preferred embodiment of this invention uses high Q and high power handling dielectric varactors as tuning elements for the filter. The dielectric varactor used in the preferred embodiment of the present invention is made from low loss $(Ba,Sr)TiO_3$-based composite films. The typical Q factor of these dielectric varactors is 50 to 100 at 20 GHz with a capacitance ratio ($C_{max}/C_{min}$) of around 2. A wide range of capacitance is available from the dielectric varactor, for example 0.1 pF to 1 nF. The tuning speed of the dielectric varactor is about 30 ns. Therefore, practical tuning speed is determined by the bias circuits.

The present invention provides a voltage-tuned filter having low insertion loss, fast tuning speed, and low cost that operates in the microwave frequency range, especially above 10 GHz. Since the dielectric varactors show high Q, low intermodulation distortion, and low cost, the tunable filters in the present invention have the advantage of low insertion loss, fast tuning, and high power handling. Simple structure and control circuits make the dielectric tunable filter low cost.

Accordingly, the present invention, by utilizing the unique application of high Q varactors, provides a high performance microwave tunable filter. While the present invention has been described in terms of what is believed to be its preferred embodiments, it will be apparent to those skilled in the art that various changes can be made to the disclosed embodiments without departing from the scope of this invention as defined by the following claims.

What is claimed is:

1. An electronic filter comprising:

a substrate;

a ground conductor;

an input;

an output;

a first microstrip line positioned on the substrate, and electrically coupled to the input and the output; and a first tunable dielectric varactor comprising a composite selected from BSTO—MgO, BSTO—$MgAl_2O_4$, BSTO—$CaTiO_3$, BSTO—$MgTiO_3$, BSTO—$MgSrZrTiO_6$, and combinations thereof, said varactor operable at room temperature and electrically connected between the microstrip line and the ground conductor.

2. An electronic filter according to claim 1, wherein:

the input comprises a second microstrip line positioned on the substrate and having a first portion lying parallel to the first microstrip line; and the output comprises a third microstrip line positioned on the substrate and having a first portion lying parallel to the first microstrip line.

3. An electronic filter according to claim 1, wherein said first microstrip line includes a first end and a second end, the first end of said first microstrip line being open circuited and said varactor being connected between the second end of said first microstrip line and the ground conductor.

4. An electronic filter according to claim 1, further comprising:

a first bias voltage circuit including a strip line, a radial stub extending from said strip line, and a patch connect to an end of said strip line for connection to a DC source.

5. An electronic filter according to claim 4, wherein said strip line has a higher impedance than said first microstrip line.

6. An electronic filter according to claim 1, wherein said first varactor comprises:

a substrate having a low dielectric constant with a planar surface;

a tunable dielectric layer on the planar surface of the substrate, said tunable dielectric layer including a Barium Strontium Titanate composite; and first and second electrodes on the tunable dielectric layer and positioned to form a gap between said first and second electrodes.

7. An electronic filter according to claim 6, wherein said Barium Strontium Titanate composite consists of a material selected from the group:

BSTO—MgO, BSTO—$MgAl_2O_4$, BSTO—$CaTiO_3$, BSTO—$MgTiO_3$, BSTO—$MgSrZrTiO_6$, and combinations thereof.

8. An electronic filter according to claim 6, wherein each of the first and second electrodes consists of a material selected from the group:

gold, copper, silver and aluminum.

9. An electronic filter according to claim 1, further comprising:

a second microstrip line positioned on said substrate parallel to the first microstrip line;

a second tunable dielectric varactor electrically connected between the second microstrip line and the ground conductor;

a third microstrip line positioned on said substrate parallel to the first microstrip line;

a third tunable dielectric varactor electrically connected between the second microstrip line and the ground conductor.

10. An electronic filter according to claim 9, wherein the first, second and third microstrip lines are of equal length.

11. An electronic filter according to claim 9, further comprising:

a plurality of bias voltage circuits for supplying bias voltage to said first, second and third varactors, each of said bias voltage circuits including strip line, a radial stub extending from said strip line, and a patch connected to an end of said strip line for connection to a DC source.

12. An electronic filter according to claim 11, wherein said strip line has a higher impedance than said first microstrip line.

13. An electronic filter according to claim 9, wherein each of said second and third microstrip lines includes a first end and a second end, the first end of each of said second and third microstrip lines being open circuited, said second tunable varactor being connected between the second end of said second microstrip line and the ground conductor, and said third tunable varactor being connected between the second end of said third microstrip line and the ground conductor.

14. An electronic filter according to claim 9, wherein each of said varactors comprises:

a substrate having a low dielectric constant with a planar surface;

a tunable dielectric layer on the planar surface of the substrate, said tunable dielectric layer including a Barium Strontium Titanate composite; and first and second electrodes on the tunable dielectric layer and positioned to form a gap between said first and second electrodes.

15. An electronic filter according to claim 14, wherein said Barium Strontium Titanate composite consists of a material selected from the group:

BSTO—MgO, BSTO—$MgAl_2O_4$, BSTO—$CaTiO_3$, BSTO—$MgTiO_3$, BSTO—$MgSrZrTiO_6$, and combinations thereof.

16. An electronic filter according to claim 14, wherein each of the first and second electrodes consists of a material selected from the group:

gold, copper, silver and aluminum.

* * * * *